US005611656A

United States Patent [19]

Davis et al.

[11] Patent Number: 5,611,656

[45] Date of Patent: Mar. 18, 1997

[54] LINKAGE ARRANGEMENT FOR A WORK IMPLEMENT

[75] Inventors: James G. Davis, Knightdale; Jeffrey A. Deneve; James A. Joy, both of Clayton, all of N.C.

[73] Assignee: Caterpillar Inc., Peoria, Ill.

[21] Appl. No.: 522,473

[22] Filed: Aug. 31, 1995

[51] Int. Cl.[6] ..... B66C 23/00

[52] U.S. Cl. ..... 414/694; 414/685

[58] Field of Search ..... 414/685, 690, 414/691, 694, 695.5, 696, 723

[56] References Cited

U.S. PATENT DOCUMENTS

| | | | |
|---|---|---|---|
| 2,738,889 | 3/1956 | Fritsch | 414/694 |
| 3,042,233 | 7/1962 | Wills | 414/694 |
| 3,080,076 | 3/1963 | Randall | 414/694 |
| 3,412,880 | 11/1968 | Tweedale | 414/694 |
| 3,997,068 | 12/1976 | Lock . | |
| 3,999,670 | 12/1976 | Weyhausen . | |
| 4,360,311 | 11/1982 | Dufour | 414/687 |
| 4,810,162 | 3/1989 | Foster | 414/723 |
| 4,836,741 | 6/1989 | St. Louis et al. | 414/723 |
| 5,244,337 | 9/1993 | Stenger | 414/687 |

FOREIGN PATENT DOCUMENTS

| | | | |
|---|---|---|---|
| 215105 | 3/1968 | U.S.S.R. | 414/694 |

*Primary Examiner*—Karen B. Merritt
*Assistant Examiner*—Gregory A. Morse
*Attorney, Agent, or Firm*—Claude F. White; Diana L. Charlton

[57] ABSTRACT

A linkage arrangement for guiding and manipulating a work implement, such as a bucket, includes a V-shaped guide link and a curved implement link. A plurality of pin joints connect the implement link to the bucket, the guide link, and to a fluid cylinder. The fluid cylinder, the guide link, and the implement link cooperate to rotate the bucket between open and closed positions, for digging and carrying materials. The linkage arrangement provides high forces for digging and bucket rotation and desirable lower rotational velocity for clamping object in the fully closed position.

7 Claims, 2 Drawing Sheets

LINKAGE ARRANGEMENT FOR A WORK IMPLEMENT

TECHNICAL FIELD

This invention relates generally to work implements for work machines and more particularly to a linkage arrangement for manipulating such work implements.

BACKGROUND ART

Earthmoving and construction machines, such as excavators and backhoe loaders, have a bucket or other type of work implement pivotably connected to one end of a stick or structural beam. Various linkage arrangements are used to manipulate the work implement to perform a variety of work functions. When the work implement is a bucket, the various linkage arrangements generally provide high digging forces or high rotation of the bucket. The prior art linkage arrangements have not been able to provide both high digging forces and high rotation of the bucket to achieve good bucket positioning.

The present invention is directed to overcoming one or more of the problems as set forth above.

DISCLOSURE OF THE INVENTION

In one aspect of the present invention, a linkage arrangement for guiding and manipulating a work implement of a work machine includes a work implement, such as a bucket, for performing a work function, a structural beam for supporting the work implement, a fluid cylinder connected to the beam, a guide link, and an implement link. The implement link includes three pin connections for connecting the implement link to the fluid cylinder, to the implement, and to the guide link.

When work machines, such as excavator or backhoe loaders, utilize a bucket for digging and loading, the bucket is connected to the work machine by a linkage arrangement. Various types of linkage arrangements have been used to provide different degrees of bucket digging forces, bucket rotation, and bucket angular velocity. With a linkage arrangement offering high digging forces, the degree of bucket rotation is generally low, and with a linkage arrangement offering a high degree of bucket rotation, the digging forces are generally low.

The subject linkage arrangement provides a solution to the above noted problems by maintaining a higher force level, keeping the bucket velocities low, and maintaining a high degree of bucket rotation.

BEST MODE FOR CARRYING OUT THE INVENTION

Figure 1:
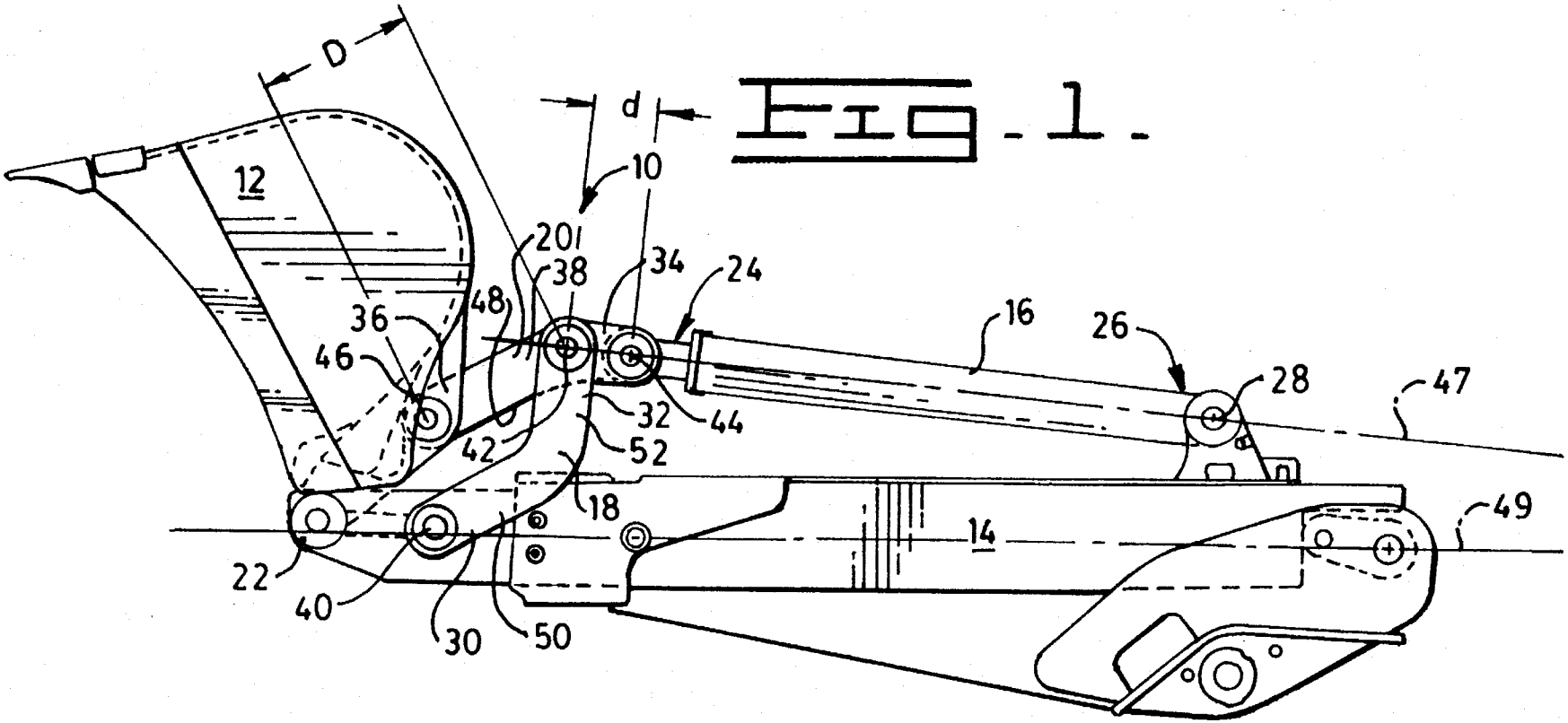
FIG. 1 is a diagrammatic side elevational view of the subject linkage arrangement with a bucket work implement in an open position.

With reference to the drawings, a linkage arrangement 10 for guiding and manipulating a work implement 12, such as a bucket 12, of a work machine (not shown) includes a structural beam, or dipper stick 14, a fluid cylinder 16, a first guide link 18, and a second implement link 20. The beam 14 pivotally supports the bucket 12 on a pivot pin 22. The fluid cylinder 16 has first and second end portions 24, 26 with the second end portion 26 being connected by a pin joint 28 to the beam 14. The first guide link 18 has first and second end portions 30, 32 and the second implement link 20 has first and second end portions 34, 36 and a middle portion 38.

The first end portion 30 of the guide link 18 is pivotably connected by a pin joint 40 to the beam 14, and the second end portion 32 is pivotably connected by a pin joint 42 to the middle portion 38 of the implement link 20. The first end portion 34 of the implement link 20 is pivotably connected by a pin joint 44 to the first end portion 24 of the fluid cylinder 16, and the second end portion 36 of the implement link 20 is pivotably connected by a pin joint 46 to the bucket 12. The implement link 20 is substantially boomerang shaped and includes a curved portion 48. The pin joint 42 which pivotably connects the guide link 18 to the implement link 20 is adjacent the curved portion 48. The pin joints 42 and 46 define a first distance "D" and the pin joints 42 and 44 define a second distance "d". The first distance "D" is substantially greater than the second distance "d".

Figure 2:
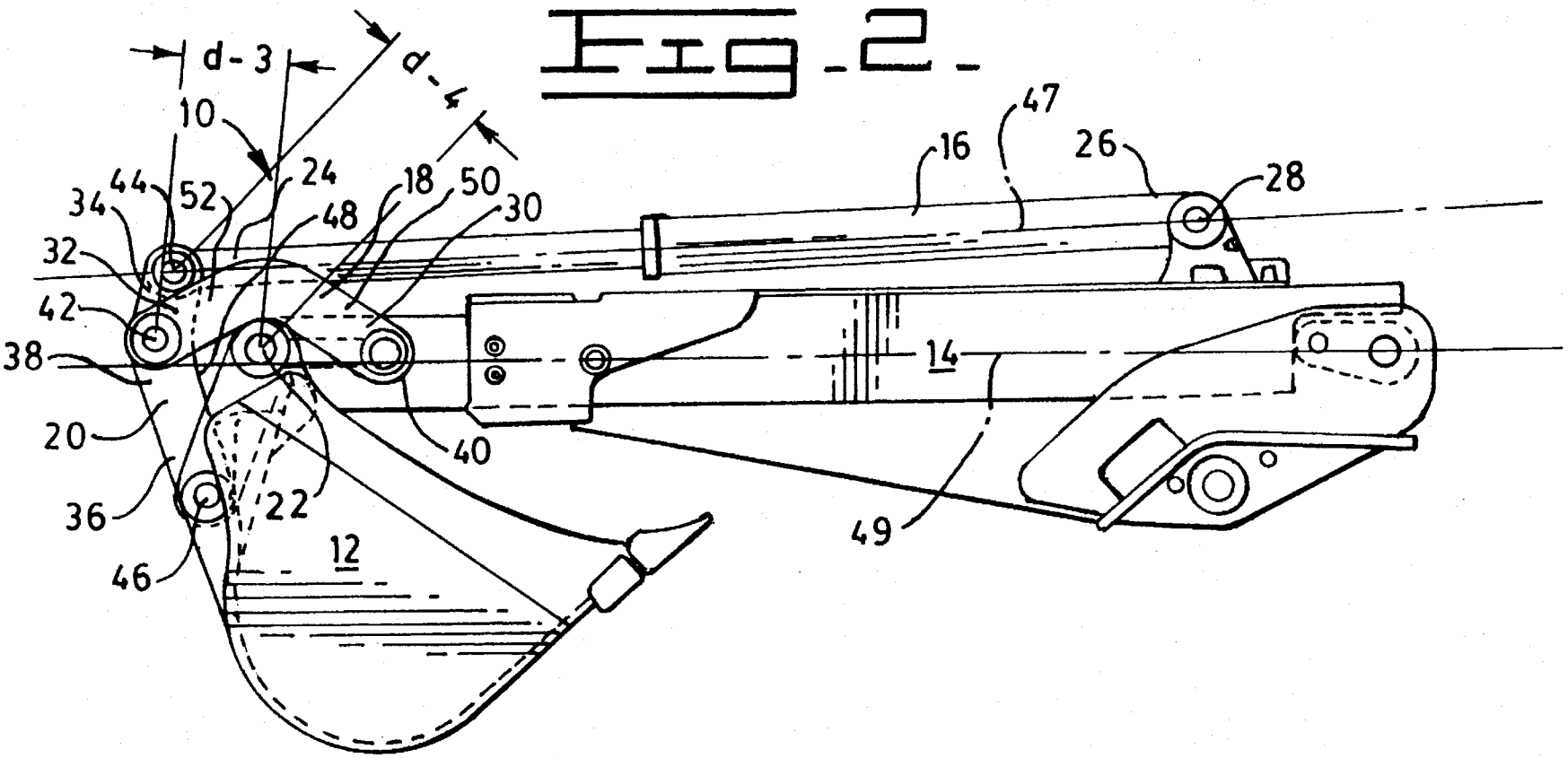
FIG. 2 is a diagrammatic side elevational view, similar to FIG. 1, with the bucket work implement in a closed position.

In the closed position of the bucket 12, as shown in FIG. 2, the pin joint 42 and the pivot pin connection 22 define a third distance "d-3", and the pin joint 44 and the pivot pin connection 22 define a fourth distance "d-4". The third distance "d-3" is about equal to the fourth distance "d-4". This ensures that the first end portion 24 of the fluid cylinder 16 remains spaced a considerable distance from the stick 14, and the mechanical advantage of the linkage arrangement remains high. The fluid cylinder 16 includes a first longitudinal axial centerline 47 and the structural beam 14 includes a second longitudinal axial centerline 49. In the closed position of the bucket 12, axial centerlines 47 and 49 converge toward the bucket 12. In the open position of the bucket 12, axial centerlines 47 and 49 converge away from the bucket 12.

The guide link 18 includes first and second leg portions 50, 52 which are connected to form a "V" shape. The first end portion 30 of the guide link 18 is at or adjacent the outer extremity of the first leg portion 50, and the second end portion 32 is at or adjacent the outer extremity of the second leg portion 52.

Industrial Applicability

With reference to the drawings, and the previous detailed description, the subject linkage arrangement 10 is particularly useful with excavating and backhoe loading machines. Such machines are utilized to excavate trenches, and remove and load material into trucks or other hauling machines. The fluid cylinder 16, the guide link 18, and the implement link 20 cooperate to rotate the bucket between an open position, as shown in FIG. 1, and a closed position, as shown in FIG. 2. In the open position, the bucket 12 is in a position to begin a digging operation wherein the subject linkage arrangement 10 provides a large digging and breakout force. The linkage arrangement 10 also provides a leveling of the forces and bucket velocity as the bucket 12 rotates between the fully open position and the fully closed position. When the bucket is opening to dump material, a high bucket velocity is needed to shake the material from the bucket. When the bucket is closing, a lower velocity is desirable to retain material in the bucket. The subject linkage 10 arrangement further provides a desirable bucket rotation position wherein the bucket is closely adjacent the stick 14 to clamp material in the fully closed position of the bucket 12.

Other aspects, object, and advantages of this invention can be obtained from a study of the drawings, the disclosure, and the appended claims.

We claim:

1. A linkage arrangement for guiding and manipulating a work implement of a work machine, comprising:

a work implement adapted to perform a work function;

a structural beam for pivotably supporting said work implement;

a fluid cylinder having first and second end portions, said second end portion being connected to said structural beam;

a guide link having first and second end portions with said first end portion pivotably connected to said structural beam; and a implement link having first and second end portions and a middle portion, said first end portion being pivotably connected to said first end portion of said fluid cylinder, said second end portion being pivotably connected to said work implement, and said middle portion being pivotably connected to said second end portion of said guide link.

2. A linkage arrangement, as set forth in claim 1, wherein said guide link has first and second legs portions which are connected to form a V-shape.

3. A linkage arrangement, as set forth in claim 2, wherein said first end portion of said guide link is at the outer extremity of said first leg portion and said second end portion is at the outer extremity of said second leg portion.

4. A linkage arrangement, as set forth in claim 1, wherein said implement link is boomerang shaped including a curved portion and said pivotal connection between said guide link and said implement link is adjacent said curved portion.

5. A linkage arrangement, as set forth in claim 1, wherein the connection between said implement link and said work implement and the connection between said implement link and said guide link define a first distance, and the connection between said implement link and said guide link and the connection between the implement link and said fluid cylinder define a second distance, said first distance being greater than said second distance.

6. A linkage arrangement, as set forth in claim 1, wherein a pin joint between said implement link and said guide link and a pivot pin connection of the beam and the work implement define a third distance when said work implement is in a closed position where the fluid cylinder is substantially extended, and a pin joint between said implement link and said fluid cylinder and the pivot pin connection of the beam and the work implement define a fourth distance, said third distance being about equal to said fourth distance.

7. A linkage arrangement, as set forth in claim 1, wherein said fluid cylinder has a first axial centerline and said work implement has a second axial centerline, said first and second axial centerlines converging toward said work implement in a closed position where the fluid cylinder is substantially extended.

* * * * *

US005611656B1

(12) REEXAMINATION CERTIFICATE (4458th)

United States Patent

Davis et al.

(10) Number: US 5,611,656 C1

(45) Certificate Issued: Oct. 16, 2001

(54) LINKAGE ARRANGEMENT FOR A WORK IMPLEMENT

(75) Inventors: James G. Davis, Knightdale; Jeffrey A. Deneve; James A. Joy, both of Clayton, all of NC (US)

(73) Assignee: Caterpillar Inc., Peoria, IL (US)

Reexamination Request:
No. 90/005,508, Sep. 27, 1999

Reexamination Certificate for:

| | |
|---|---|
| Patent No.: | **5,611,656** |
| Issued: | **Mar. 18, 1997** |
| Appl. No.: | **08/522,473** |
| Filed: | **Aug. 31, 1995** |

(51) Int. Cl.[7] ..... B66C 23/00

(52) U.S. Cl. ..... 414/694; 414/685

(58) Field of Search ..... 414/685, 694, 414/690, 691, 695.5; 37/443, 444, 403

(56) References Cited

U.S. PATENT DOCUMENTS

| | | | |
|---|---|---|---|
| 2,590,454 | 3/1952 | Pilch | 121/38 |
| 2,738,889 | 3/1956 | Fritsch | 214/138 |
| 2,753,059 | 7/1956 | Pilch | 214/140 |
| 3,042,233 | 7/1962 | Wills | 214/138 |
| 3,080,076 | 3/1963 | Randall | 214/138 |
| 3,243,065 | 3/1966 | Moore | 214/138 |
| 3,243,067 | 3/1966 | Artman | 214/140 |
| 3,412,880 | 11/1968 | Tweedale | 214/138 |
| 3,510,017 | 5/1970 | Guinot | 214/138 |
| 3,536,215 | 10/1970 | Waite | 214/138 |
| 3,550,795 | 12/1970 | Schofield | 214/138 |
| 3,997,068 | 12/1976 | Lock | 214/145 |
| 3,999,670 | 12/1976 | Weyhausen | 214/138 |
| 4,239,444 | 12/1980 | Schmelzer | 414/685 |
| 4,277,899 | 7/1981 | Güthoff | 37/103 |
| 4,360,311 | 11/1982 | Dufour | 414/687 |
| 4,364,705 | 12/1982 | Shumaker | 414/713 |
| 4,381,167 | 4/1983 | Baty | 414/697 |
| 4,403,429 | 9/1983 | Haringer | 37/103 |
| 4,480,942 | 11/1984 | Farrow | 405/154 |
| 4,639,183 | 1/1987 | Güthoff | 414/705 |
| 4,768,917 | 9/1988 | Garman | 414/697 |
| 4,810,162 | 3/1989 | Foster | 414/723 |
| 4,836,741 | 6/1989 | St. Louis et al. | 414/723 |
| 5,051,057 | 9/1991 | Kremer | 414/685 |
| 5,176,491 | 1/1993 | Houkom | 414/694 |
| 5,188,502 | 2/1993 | Tonsor et al. | 414/700 |
| 5,244,337 | 9/1993 | Stenger | 414/687 |

FOREIGN PATENT DOCUMENTS 215105 3/1968 (SU) .

OTHER PUBLICATIONS

"Excavators", 1985 by Blandford press, Link House, West Streeet, Poole, Dorset, BH15 1LL, U.K.; Copyright 1985 Peter N. Grimshaw; Dist. In U.S. by Sterling Publishing Co., Inc., 2 Park Avenue, New York, NY 10016.

Three photos of Lokomo excavator including brief description of excavator's benefits. (No Date Shown).

Caterpillar Integrated Tool Carrier Linkage, Jan. 1993.

JCB Backhoe Loader Parts Book, Publication No. 9800/8552, cover page. (Date Unknown).

John Deere Extendable Dipperstick Advertisement. (Date Unknown).

Caterpillar 416B Advertisement. (Date Unknown).

Liebherr Advertisement Picture. (Date Unknown).

*Primary Examiner*—Gregory Morse

(57) ABSTRACT

A linkage arrangement for guiding and manipulating a work implement, such as a bucket, includes a V-shaped guide link and a curved implement link. A plurality of pin joints connect the implement link to the bucket, the guide link, and to a fluid cylinder. The fluid cylinder, the guide link, and the implement link cooperate to rotate the bucket between open and closed positions, for digging and carrying materials. The linkage arrangement provides high forces for digging and bucket rotation and desirable lower rotational velocity for clamping object in the fully closed position.

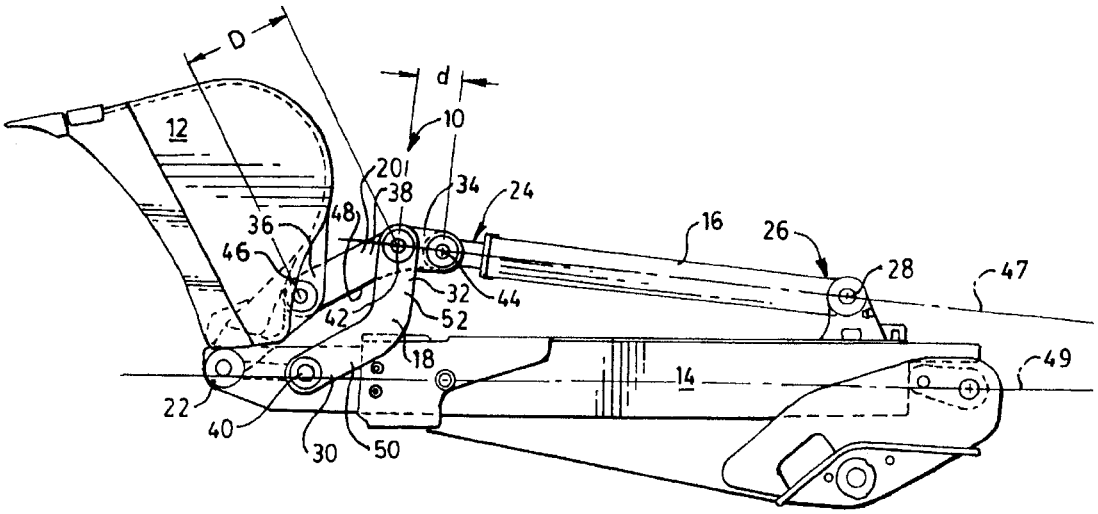

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–7 are cancelled.

* * * * *